US006045107A

United States Patent [19]

Carlson

[11] Patent Number: 6,045,107

[45] Date of Patent: Apr. 4, 2000

[54] HOLDER FOR READING MATERIAL

[76] Inventor: Terry A. Carlson, 11319 N. Kentucky, Champlin, Minn. 55316

[21] Appl. No.: 09/207,930

[22] Filed: Dec. 9, 1998

[51] Int. Cl.[7] ..... A47B 23/00

[52] U.S. Cl. ..... 248/445; 248/175

[58] Field of Search ..... 248/441.1, 445, 248/444.1, 175; 281/45; 5/503.1, 658, 659, 504.1

[56] References Cited

U.S. PATENT DOCUMENTS

| | | | |
|---|---|---|---|
| 2,448,734 | 9/1948 | Phillips | 45/82 |
| 2,546,283 | 3/1951 | Webster | 311/28 |
| 2,741,869 | 4/1956 | Aibel | 45/82 |
| 2,828,577 | 4/1958 | Anderson | 45/80 |
| 2,908,465 | 10/1959 | Lykes | 248/166 |
| 3,103,760 | 9/1963 | Gould | 45/82 |
| 3,128,573 | 4/1964 | Johnson | 45/80 |
| 3,497,882 | 3/1970 | Weeks | 5/332 |
| 3,740,015 | 6/1973 | Adams | 248/445 |
| 4,431,156 | 2/1984 | Mena | 248/445 |
| 4,465,255 | 8/1984 | Hill | 248/441.1 |
| 4,718,630 | 1/1988 | Richard | 248/444.1 |
| 4,867,407 | 9/1989 | Becker | 248/444.1 |
| 4,925,144 | 5/1990 | White | 248/445 |
| 5,058,848 | 10/1991 | Ferraro | 248/441.1 |
| 5,112,021 | 5/1992 | Greene | 248/444.1 |
| 5,129,616 | 7/1992 | Carson | 248/457 |
| 5,259,581 | 11/1993 | Goldberg | 248/444.1 |
| 5,351,927 | 10/1994 | Howell | 248/444.1 |

*Primary Examiner*—Ramon O. Ramirez
*Assistant Examiner*—Jon A. Szumny

[57] ABSTRACT

A holder for reading material while reclined such that the holder is light, portable, and easy to use. The holder allows for easy turning of pages and sufficient support for the reading material. The holder for reading material comprises a pair of horizontal base footings which are attached to a pair of vertical legs. The pair of vertical legs are attached to a pair of horizontal arms which support the reading material. A v-shaped piece is attached to the horizontal arms. The v-shaped piece assists in supporting the reading material. A pair of page clips are attached to the pair of horizontal arms. The pair of page clips clasp the pages of the book, thus, holding the book open to the page currently being read by the reader.

6 Claims, 3 Drawing Sheets

HOLDER FOR READING MATERIAL

SPECIFICATION

The present invention relates generally to supports for reading materials. More particularly, the invention concerns an apparatus which supports reading material while the reader is in a reclined position.

DISCUSSION OF THE INVENTION

People have enjoyed reading for many years. Many people enjoy reading just prior to sleeping. People generally either sit or lay while reading. If a person is sitting while they are reading they may rest the book or other reading material on their legs or on a table in front of them. If a person is supine while they are reading, positioning the book becomes more difficult.

People may lay the book on a bed, couch or other surface and then they may lay on their stomach propping themselves up with their elbows so that they may read the book. This position becomes uncomfortable quickly. Peoples' arms and/or wrists may become sore or their arms and/or wrists may fall asleep.

A person may lay a book on a bed, couch or other surface and then he may lay on his side propping himself up with one of his elbows. In this position, a person may support his head on his hand. This position tends to cause wrists to become sore or fall asleep.

People may recline on their backs propped up by pillows. They would then hold the book or other reading material in their hands. This position tends to become uncomfortable because of neck stiffness and the effort of supporting a book in front of them at a high enough level so that they are able to read from it. Some people may be unable to read in this position because of carpal tunnel which may cause pain in their hands or cause their hands to become numb or fall asleep. Individuals suffering from arthritis may also be unable to read in this position because of stiffness in their hands.

Some people may not be able to use many of the reading positions discussed above because of physical disabilities. People who are paralyzed or who have limited mobility in their arms will be unable to lay on their front sides propped up by their elbows. Some people are not able to lay on their sides propped up on one elbow. Some people are not able to lay on their backs and support a book or other reading material so that they may read it.

Various devices exist which resolve some of the difficulties of reading while reclined. Many of these devices are large and heavy. Many of these devices are immobile. Many contain glass or other transparent plates on which the book rests creating a difficulty in turning pages as well as a possible danger that the plate may fall upon the reader. Most of these devices are bulky.

One of the prior devices has a base which fits under the side of a mattress. The device contains arms which support a transparent table that a book or other reading material lays upon so that the reader, lying under the transparent table, is able to see through the table to read the book. To turn the pages of a book while using this device, one would need to roll out from underneath the table. Next, he/she would need to sit up and remove the book from the holder. Then, he/she could turn the page of the book. Lastly, he/she could lay back down underneath the table. See U.S. Pat. No. 4,465,255 (Hill). This device would be very difficult to use for some individuals with diminished mobility and diminished use of their arms and/or hands.

Another device which one may use to support a book for reading while reclined is an apparatus which contains a base. This base is placed under the mattress at the head of the bed. This apparatus has arms which are positioned above the reader's head. This device contains a transparent panel upon which the reading material is placed. This device creates the same difficulty in page turning, as well as the same difficulty of use for some individuals, as does the above-mentioned Hill device. See U.S. Pat. No. 4,431,156 (Mena).

Another device attempts to solve the difficulties of reading while in a reclined position. This device provides a base with wheels; thus, providing more mobility of the device than the previous devices. However, this device is large and not easily transportable. This device provides a transparent cover plate and a back plate. The book or reading material is to be placed between these two plates. The back plate holds the book above the cover plate which allows an individual to turn the pages by sliding the cover plate away from the back plate. If the cover plate is slipped too far from the back plate, the reader may lose track of the pages he/she had recently finished reading and then not know at which page to open the book. See U.S. Pat. No. 5,351,927 (Howell).

Another device provides a clamp to enable the user to clamp the device to a bed rail or arm rest of a chair. This device has a back plate and a transparent front plate. If the reader sits up, he/she may then rotate the plates of the device so that the transparent surface faces the ceiling. This plate is then moved to the side and the page may be turned. The transparent plate is then moved back into place. The device is then rotated to allow the reader to lay back down and read the next two pages. See U.S. Pat. No. 5,259,581 (Goldberg).

Another device is portable and may be used while reading in bed or used as a lap table while sitting. This device contains a transparent panel connected to four legs and a frame. This device does not provide an easy manner in which to turn the pages of the reading material while laying down. See U.S. Pat. No. 4,718,630 (Richard).

Another device is mountable to a wall behind a bed. This device consists of a main arm portion. The lower portion of the arm attaches to a wall. The upper portion arches over the reader while he/she lays in bed. This device also contains a standing support if one chooses to have this device stand on the floor instead of being attached to a wall. A tray bracket is pivotally attached to the upper portion of the arm which is located above the reader. This device is large and needs heavy support to prevent it from falling onto the reader while he/she is reading or sleeping under it. See U.S. Pat. No. 5,112,021 (Greene).

Several devices exist which may be used for reading while laying in bed. Many of these are large and heavy. These may injure a reader who is laying beneath them if these devices tip over or if portions of the devices fail. Many of these devices have transparent plates. These plates create a difficulty in page turning.

SUMMARY OF THE INVENTION

In the following description as well as in the claims the term "book" or "books" will represent all reading matter, including magazines, letters, newspapers, and all other matter which may be read.

The present invention provides an innovative portable device that holds a book above the reader's head, while the reader is in a supine or laying position. The pages of the book are held by the book holder and the page clips.

The first embodiment of this invention is comprised of a continuous rod. The continuous rod may be bent to form a first lower horizontal portion for securement beneath a pillow upon which the reader is resting his or her head. The first lower horizontal portion may have a forward portion. A first vertical portion may extend upwardly from the forward portion of the first lower horizontal portion. The first vertical portion may have an upper end.

A first upper horizontal portion may extend rearwardly from the upper end of the first vertical portion. The first upper horizontal portion may have a rearward end. A second upper horizontal portion may extend forwardly and inwardly from the rearward end. The second upper horizontal portion may have a forward end.

A third upper horizontal portion may extend rearwardly and outwardly from the forward end of the second upper horizontal portion. The third upper horizontal portion may have a rearward end. A fourth upper horizontal portion may extend forwardly from the rearward end of the third upper horizontal portion. The fourth upper horizontal portion may have a forward end.

A second vertical portion may extend downwardly from the forward end of the fourth upper horizontal portion. The second vertical portion may have a lower end. A second lower horizontal portion may extend rearwardly from the lower end of the second vertical portion.

A pair of page clips may be removably attached to the first and fourth upper horizontal portions. The reading material is placed above the first and fourth upper horizontal portions and below the second and third upper horizontal portions. The pages are held so that a reader is able to lay under the book and read.

DETAILED DESCRIPTION OF THE INVENTION

Figure 1:
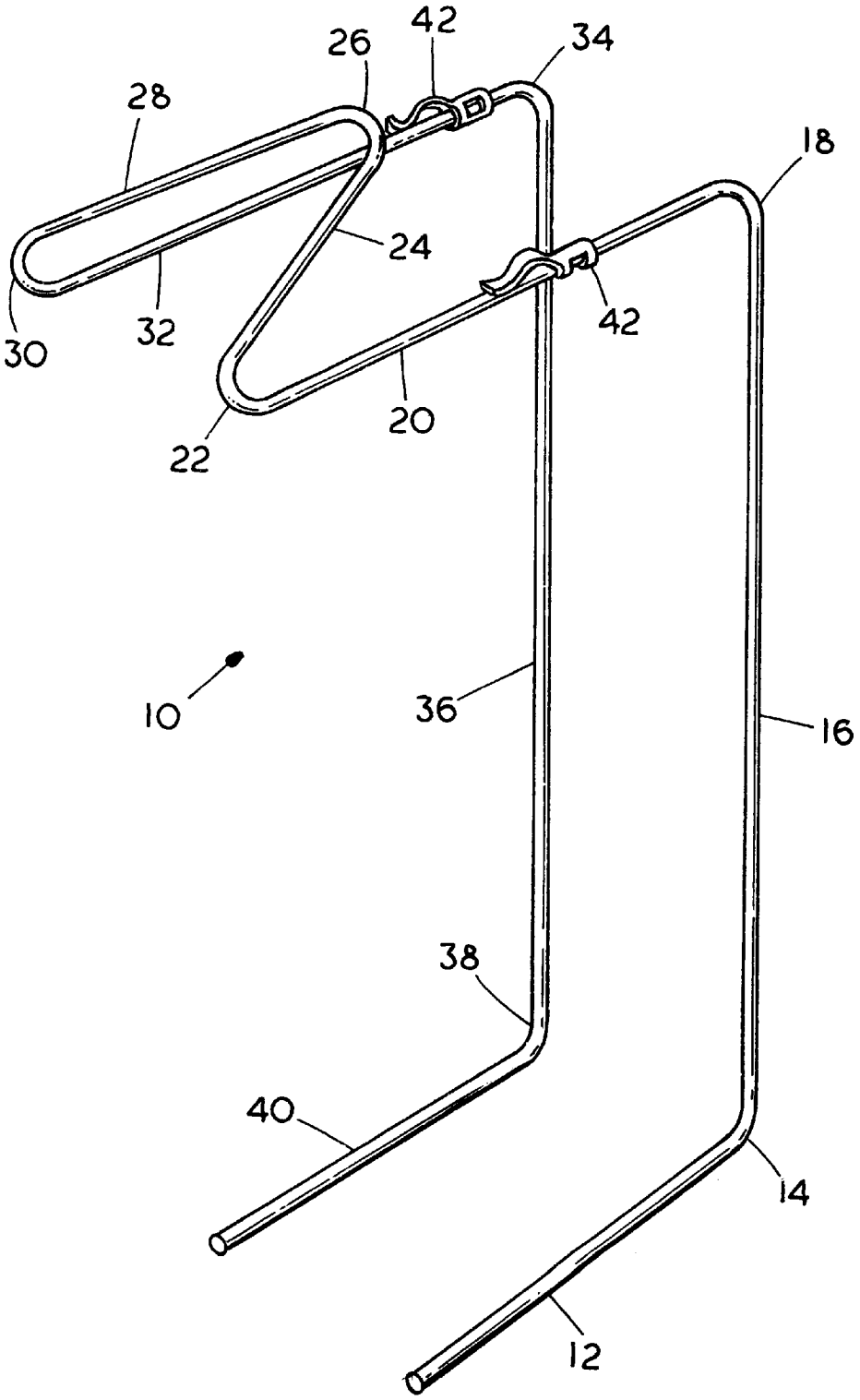
FIG. 1 is a partial perspective side view of the first embodiment.

A first embodiment 10 of this invention is comprised of a continuous rod. The continuous rod may be bent to form a first lower horizontal portion 12 for securement beneath a pillow upon which the reader is resting his or her head. The first lower horizontal portion 12 may have a forward portion 14. A first vertical portion 16 may extend upwardly from the forward portion 14 of the first lower horizontal portion 12.

The first vertical portion 16 may have an upper end 18. A first upper horizontal portion 20 may extend rearwardly from the upper end 18 of the first vertical portion 16. The first upper horizontal portion 20 may have a rearward end 22. A second upper horizontal portion 24 may extend forwardly from the rearward end 22. The second upper horizontal portion 24 may have a forward end 26.

A third upper horizontal portion 28 may extend rearwardly and outwardly from the forward end 26 of the second upper horizontal portion 24. The third upper horizontal portion 28 may have a rearward end 30.

A fourth upper horizontal portion 32 extends forwardly from the rearward end 30 of the third upper horizontal portion 28. The fourth upper horizontal portion 32 may have a forward end 34.

A second vertical portion 36 extends downwardly from the forward end 34 of the fourth upper horizontal portion 32. The second vertical portion 36 may have a lower end 38.

A second lower horizontal portion 40 extends rearwardly from the lower end 38 of the second vertical portion 36.

A pair of page clips 42 may be removably attached to the first upper horizontal portion 20 and the fourth upper horizontal portion 32.

The continuous rod may be comprised of any sturdy material such as plastic, wood, aluminum, metal, rubber, or other sturdy material. A preferred material is rigid plastic. The diameter of the rod may range from ¼ inch to 2 inches. The preferred diameter is approximately ½ inch to 1 inch.

The length of each portion may vary. The length of the first vertical portion 16 and the second vertical portion 36 may range from eight inches to thirty-six inches. The preferred length is approximately twenty inches.

The length of the first lower horizontal portion 12 and the second lower horizontal portion 40 may range from four inches to twenty-four inches. The length must be long enough to allow the device to be balanced and, therefore, not fall over. The preferred length of the first lower horizontal portion 12 and second lower horizontal portion 40 is approximately twelve inches.

The length of the first upper horizontal portion 20 and the fourth upper horizontal portion 32 may range from six to eighteen inches. The length of the first upper horizontal portion 20 and the length of the fourth upper horizontal portion 32 must be long enough to support the reading material.

The length of the second upper horizontal portion 24 and the length of the third upper horizontal portion 28 may range from four to twelve inches. The length of the second upper horizontal portion 24 and the length of the third upper horizontal portion 28 must be long enough to support the reading material.

Figure 2:
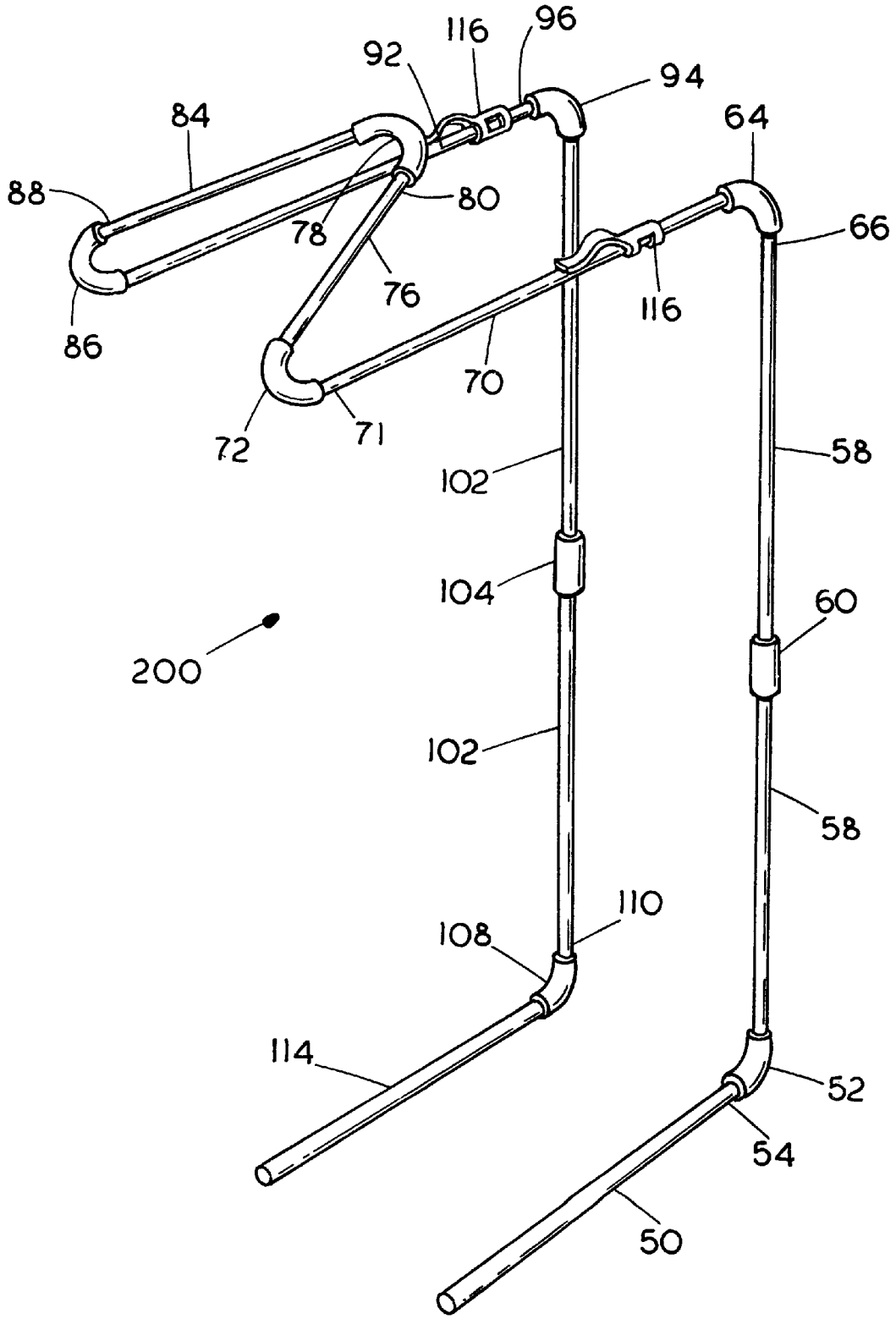
FIG. 2 is a partial perspective side view of the second embodiment.
Figure 3:
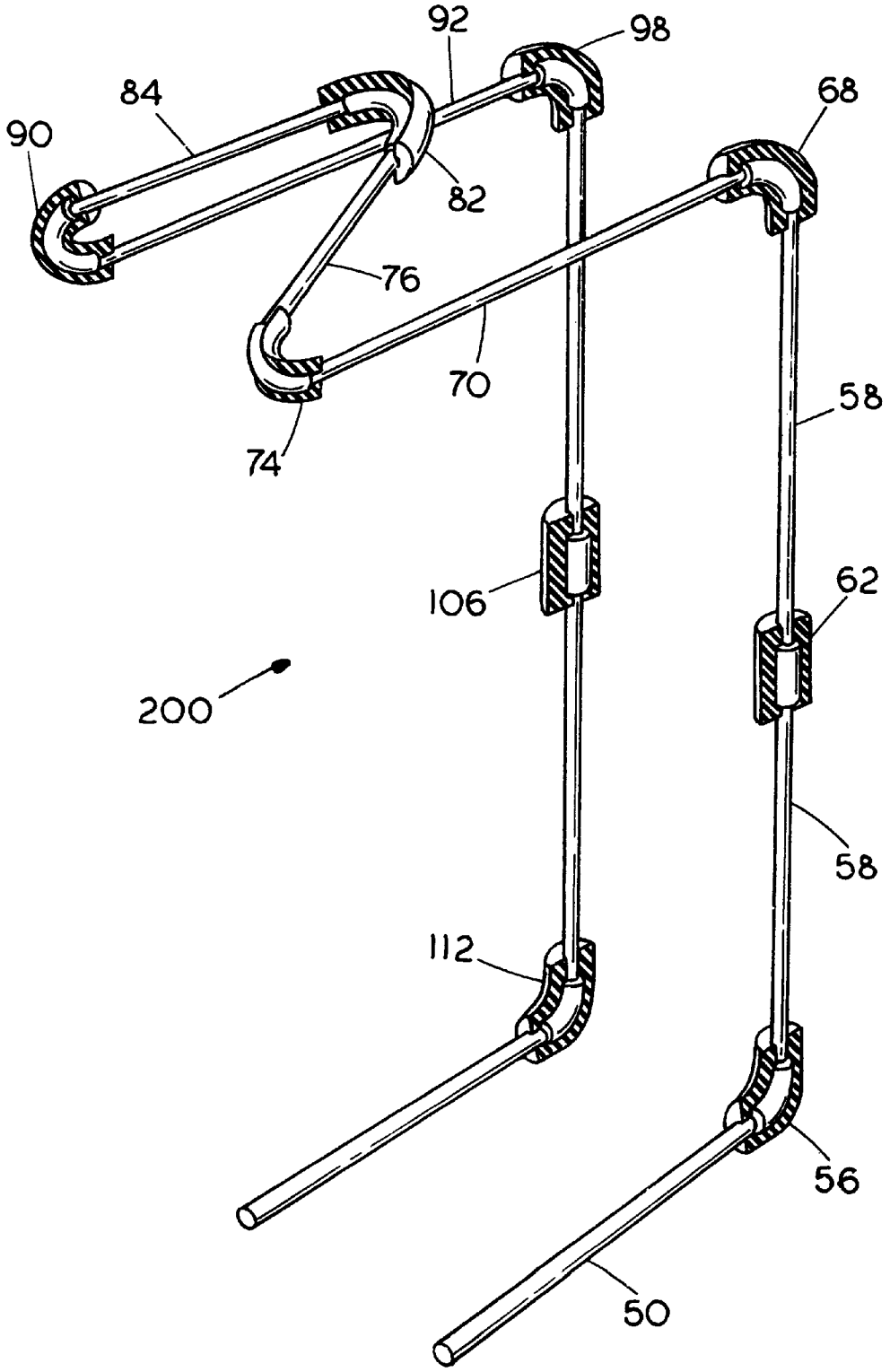
FIG. 3 is a partial perspective side view of the second embodiment showing the position of the sleeves.

Second embodiment:

A second embodiment of the holder for reading material is illustrated in FIGS. 2 and 3. The second embodiment provides an innovative portable device that supports a book above the reader's head, while the reader is in a supine position. This embodiment is collapsible for easy storage and transport.

The second embodiment 200 may have a first lower horizontal portion 50 for securement beneath a pillow upon which the reader is resting his or her head. A first selectively adjustable joint 52 may be located at the forward end 54 of the first lower horizontal portion 50. The first selectively adjustable joint 52 may be covered by a first sleeve 56.

A first vertical portion 58 may be extend upwardly from the first selectively adjustable joint 52. The first vertical portion 58 may have a first mid-section selectively adjustable joint 60 which may be covered by a first mid-section sleeve 62. A second selectively adjustable joint 64 may be located at the upper end 66 of the first vertical portion 58. The second selectively adjustable joint 64 may be covered by a second sleeve 68.

A first upper horizontal portion 70 may extend rearwardly from the second selectively adjustable joint 64. A third selectively adjustable joint 72 may be located at the rearward end 71 of the first upper horizontal portion 70. The third selectively adjustable joint 72 may be covered by a third sleeve 74.

A second upper horizontal portion 76 may extend forwardly and inwardly from the third selectively adjustable joint 72. A fourth selectively adjustable joint 78 may be located at the forward end 80 of the second upper horizontal portion 76. The fourth selectively adjustable joint 78 may be covered by a fourth sleeve 82.

A third upper horizontal portion 84 may extend rearwardly and outwardly from the fourth selectively adjustable joint 78. A fifth selectively adjustable joint 86 may be located at the rearward end 88 of the third upper horizontal portion 84. The fifth selectively adjustable joint 86 may be covered by a fifth sleeve 90.

A fourth upper horizontal portion 92 may extend forwardly from the fifth selectively adjustable joint 86. A sixth selectively adjustable joint 94 may be located at the forward end 96 of the fourth upper horizontal portion 92. The sixth selectively adjustable joint 94 may be covered by a sixth sleeve 98.

A second vertical portion may 102 extend downwardly from the sixth selectively adjustable joint 94. The second vertical portion 102 may have a second mid-section selectively adjustable joint 104 which may be covered by a second mid-section sleeve 106. A seventh selectively adjustable joint 108 may be located at the lower end 110 of the second vertical portion 102. The seventh selectively adjustable joint 108 may be covered by a seventh sleeve 112.

A second lower horizontal portion 114 may extend rearwardly from the seventh selectively adjustable joint 108. The second lower horizontal portion 114 may be placed under the reader's pillow for support of the device.

A pair of page clips 116 may be removably attached to the first and fourth upper horizontal portions 70, 92. The reading material is placed above the first and fourth upper horizontal portions 70, 92 and below the second and third upper horizontal portions 76, 84. The pages are held so that a reader is able to lay under the book and read.

The first lower horizontal portion 50 and the second lower horizontal portion 114 may be longer than they are wide or tall. For example, the length of the first lower horizontal portion 50 and the second lower horizontal portion 114 may be twelve inches and diameter may be ½ inch. The length may range from four inches to thirty-six inches or longer. The preferred length is approximately twelve inches.

The diameter may range from ¼ inch to two inches. The preferable diameter of the first lower horizontal portion 50 and the second lower horizontal portion 114 is approximately one inch. The height may range from ¼ inch to two inches. The preferable height is approximately one inch.

The first lower horizontal portion 50 and the second lower horizontal portion 114 may be circular, square, triangular, rectangular or any other shape in cross-section. A preferable shape of the first horizontal base member and the second lower horizontal portion 114 is circular in cross-section. The first lower horizontal portion 50 and the second lower horizontal portion 114 may be comprised of metal, aluminum, plastic, rubber, wood, or any other sturdy material. The preferable material is rigid plastic.

The first vertical portion 58 and the second vertical portion 102 are generally vertical and, therefore, provide space between the reader's face, the first lower horizontal portion 50 and the second lower horizontal portion 114 and the first, second, third and fourth upper horizontal portions 70, 76 84, and 92 of the device which supports the reading material.

The first vertical portion 58 and the second vertical portion 102 may be of slightly differing heights. Preferably the first vertical portion 58 and the second vertical portion 102 will be of approximately equal height.

The first vertical portion 58 and the second vertical portion 102 may be taller than their diameter is large. For example, the height of the first vertical portion 58 and the second vertical portion 102 may be twelve inches and their diameters may be ½ inch. The height may range from six inches to thirty-six inches or taller. A preferred height is approximately twenty-four inches.

The diameters of the first vertical portion 58 and the second vertical portion 102 may range from ¼ inch to two inches. A preferable diameter is one inch.

The first vertical portion 58 and the second vertical portion 102 may be circular, square, triangular, rectangular or any other shape in cross-section. A preferable cross-sectional shape is circular. The first vertical portion 58 and the second vertical portion 102 may be comprised of metal, aluminum, plastic, rubber, wood, or any other sturdy material. A preferable material is rigid plastic.

The first upper horizontal portion 70 and the fourth upper horizontal portion 92 may be of differing length. Preferably the first upper horizontal portion 70 and fourth upper horizontal portion 92 will be of approximately equal length.

The first upper horizontal portion 70 and the fourth upper horizontal portion 92 may be longer than their diameter is large. For example, the length of the first upper horizontal portion 70 and the fourth upper horizontal portion 92 may be twelve inches and the diameter may be ½ inch. The length may range from six inches to thirty-six inches or longer. A preferred length is approximately twelve inches.

The diameter of the first upper horizontal portion 70 and the fourth upper horizontal portion 92 may range from ¼ inch to two inches. Preferably, the diameter is approximately one inch.

The first upper horizontal portion 70 and the second upper horizontal portion 92 may be circular, square, triangular, rectangular or any other shape in cross-section. A preferred cross-sectional shape is circular. The first upper horizontal portion 70 and the second upper horizontal portion 92 may be comprised of metal, aluminum, plastic, rubber, wood, or any other sturdy material. The preferred material is rigid plastic.

The pair of page clips 116 may be individually and movably attached to the first upper horizontal portion 70 and the second upper horizontal portion 92. The movability allows the pair of page clips 116 to be adjusted to the size of the reading material which is being read.

The pair of page clips 116 may hold the pages open so that a reader is able to read the pages. When the reader finishes reading the pages, the reader may unclasp one of the page clips 116, release one page, clasp that page clip again, move the page to the left and clasp it with the other page clip so that he/she may continue reading the next two pages.

The second upper horizontal portion 76 and the third upper horizontal portion 84 may be longer than their diameter is large. For example, the length of the second upper horizontal portion 76 and the length of the third upper horizontal portion 84 may be twelve inches and the diameter may be ¼ inch. The length may range from six inches to eighteen inches or longer. A preferred length is approximately ten inches.

The diameter may range from ¼ inch to two inches. Preferably, the diameter is approximately one inch.

The second upper horizontal portion 76 and the third upper horizontal portion 84 may be circular, square, triangular, rectangular or any other shape in cross-section. A preferable cross-sectional shape is circular. The second upper horizontal portion 76 and the third upper horizontal portion 84 may be comprised of metal, aluminum, plastic, rubber, wood, or any other sturdy material. A preferred material is rigid plastic.

A book may be located upon both the first upper horizontal portion 70 and the fourth upper horizontal portion 92 and below both the second upper horizontal portion 76 and the third upper horizontal portion 84.

The first sleeve, first mid-section sleeve, second sleeve, third sleeve, fourth sleeve, fifth sleeve, sixth sleeve, second mid-section sleeve and seventh sleeve (now referred to as the sleeves) generally are quite similar to each other. However, the sleeves may differ from each other in that the length of each may be slightly different depending on their particular location on the device. The sleeves may also differ in their thicknesses depending on their location. The sleeves on the upper portion of the device may be thinner so as to not block the reading material and the sleeves on the lower portion may be thicker to protect the head of the reader from the joints.

The sleeves may all be comprised of the same material or the sleeves may be comprised of different materials. The sleeves may be comprised of foam rubber, cloth, ect.

Having now described the invention in detail, those skilled in this art will have no difficulty in making changes and modifications in the individual parts, sizes or their relative assembly in order to meet specific requirements or conditions. Such changes and modifications may be made without departing from the scope and spirit of the invention, as set forth in the following claims. In particular, it will be readily apparent to those skilled in this art that individual features of the aforementioned examples may be combined and substituted to produce many more equivalent devices.

I claim:

1. A device for supporting an open book for reading while the person reading the book is in a supine position, said device comprising:

a continuous rod having a first horizontal portion for securement beneath a pillow on which the reader may rest their head, said first horizontal portion having a forward end, a first vertical portion extending upwardly from the forward end of said first horizontal portion, the first vertical portion having an upper end, a first upper horizontal portion extending rearwardly from the upper end of the first vertical portion, the first upper horizontal portion having a rearward end, a second upper horizontal portion extending forwardly and inwardly from the rearward end of said first upper horizontal portion, the second upper horizontal portion having a forward end, a third upper horizontal portion extending rearwardly and outwardly from the forward end of said second upper horizontal portion, the third upper horizontal portion having a rearward end, a fourth upper horizontal portion extending forwardly from the rearward end of said third upper horizontal portion, the fourth upper horizontal portion having a forward end, a second vertical portion extending downwardly from the forward end of said fourth upper horizontal portion, the second vertical portion having a lower end, and a second lower horizontal portion extending rearwardly from the lower end of said second vertical portion, whereby a book for reading may be trapped between the first and second upper horizontal portions and the third and fourth upper horizontal portion while the reader relaxes and reads the exposed pages of the book.

2. The device of claim 1, further comprising a pair of page clips removably attached to the first upper horizontal portion and the fourth upper horizontal portion.

3. A device for supporting an open book for reading while the person reading the book is in a supine position, said device comprising:

a continuous rod having a first lower horizontal portion for securement beneath a pillow on which the reader may rest their head, said first lower horizontal portion having a forward end, the forward end of the first lower horizontal portion having a first selectively adjustable joint;

a first vertical portion extending upwardly from the first selectively adjustable joint, the first vertical portion having a first mid-section selectively adjustable joint, the first vertical portion having an upper end, the upper end of the first vertical portion having a second selectively adjustable joint;

a first upper horizontal portion extending rearwardly from the second selectively adjustable joint, the first upper horizontal portion having a rearward end, the rearward end of the first upper horizontal portion having a third selectively adjustable joint;

a second upper horizontal portion extending forwardly and inwardly from the third selectively adjustable joint, the second upper horizontal portion having a forward end, the forward end of the second upper horizontal portion having a fourth selectively adjustable joint;

a third upper horizontal portion extending rearwardly and outwardly from the fourth selectively adjustable joint, the third upper horizontal portion having a rearward end, the rearward end of the third upper horizontal portion having a fifth selectively adjustable joint;

a fourth upper horizontal portion extending forwardly from the fifth selectively adjustable joint, the fourth upper horizontal portion having a forward end, the forward end of the fourth upper horizontal portion having a sixth selectively adjustable joint;

a second vertical portion extending downwardly from the sixth selectively adjustable joint, the second vertical portion having a second mid-section selectively adjustable joint, the second vertical portion having a lower end, the lower end of the second vertical portion having a seventh selectively adjustable joint; and a second lower horizontal portion extending rearwardly from the seventh selectively adjustable joint, whereby a book for reading may be trapped between the first and second upper horizontal portions and the third and fourth upper horizontal portion while the reader relaxes and reads the exposed pages of the book.

4. The device in claim 3, further comprising a pair of page clips removably attached to the first upper horizontal portion and the fourth upper horizontal portion.

5. The device of claim 4, further comprising a pair of page clips removably attached to the first upper horizontal portion and the fourth upper horizontal portion.

6. The device in claim 3, further comprising the first selectively adjustable joint covered by a first sleeve, the first mid-section selectively adjustable joint covered by a first mid-section sleeve, the second selectively adjustable joint covered by a second sleeve, the third selectively adjustable joint covered by a third sleeve, the fourth selectively adjustable joint covered by fourth sleeve, the fifth selectively adjustable joint covered by fifth sleeve, the sixth selectively adjustable joint covered by sixth sleeve, the second mid-section selectively adjustable joint covered by a second mid-section sleeve, and the seventh selectively adjustable joint covered by a seventh sleeve.

* * * * *